US005990760A

United States Patent [19]

Yoshida et al.

[11] Patent Number: 5,990,760

[45] Date of Patent: Nov. 23, 1999

[54] DELAY LINE FOR PROVIDING A DELAY TIME AT A DESIRED PEAK FREQUENCY

[75] Inventors: Norio Yoshida, Otsu; Makoto Tochigi, Shiga-ken, both of Japan

[73] Assignee: Murata Manufacturing Co., Ltd., Japan

[21] Appl. No.: 08/889,019

[22] Filed: Jul. 7, 1997

[30] Foreign Application Priority Data

Jul. 8, 1996 [JP] Japan ..... 8-178228

[51] Int. Cl.[6] ..... H01P 1/18

[52] U.S. Cl. ..... 333/161

[58] Field of Search ..... 333/161, 156

[56] References Cited

U.S. PATENT DOCUMENTS

| | | | |
|---|---|---|---|
| 5,073,755 | 12/1991 | Neufeld | 333/161 X |
| 5,146,191 | 9/1992 | Mandai et al. | 333/161 |
| 5,187,455 | 2/1993 | Mandai et al. | 333/161 |
| 5,365,203 | 11/1994 | Nakamura et al. | 333/161 |

FOREIGN PATENT DOCUMENTS 4119551 1/1992 Germany .

OTHER PUBLICATIONS

Y. Nagai, et al., "Non–dispersive and Dispersive Delay Lines Using High–Tc Superconducting Films", *IEICE Transactions on Electronics*, E75–C (1992), Aug. No., 8, Tokyo, JP.

Hansson, et al., "Planar Meanderline Ferrite–Dielectric Phase Shifter", *IEEE Transactions on Microwave Theory and Techniques*, vol. MTT–29 (1981) Mar., No. 3, New York, USA.

*Primary Examiner*—Benny Lee

*Attorney, Agent, or Firm*—Ostrolenk, Faber, Gerb & Soffen, LLP

[57] ABSTRACT

A stripline-type delay line has a plurality of rectangular sheet layers which are made from a dielectric material with a relative dielectric constant ∈r of about 6.3, having magnesium oxide and silica as main components. One sheet layer is placed at the top, and the other layers are laminated thereunder in the following order: a sheet layer on which a first ground conductor is formed on its upper surface, a sheet layer on which a transmission line folded in a meander shape is formed on its upper surface, and a sheet layer on which a second ground conductor is formed on its upper surface. On side faces of the laminated dielectric and on adjacent portions of the upper and lower surfaces, an input terminal, an output terminal, and ground terminals are formed by printing, and then the dielectric is baked. The length A of the opposing line sections of said transmission line is preferably set such that the first peak frequency f of the delay time is within or above the frequency range of use, and substantially satisfies the following expression:

$$f = \frac{Co}{4A\sqrt{\epsilon r}}$$

wherein Co indicates the speed of light, and ∈r indicates the relative dielectric constant of said dielectric layers.

10 Claims, 7 Drawing Sheets

DELAY LINE FOR PROVIDING A DELAY TIME AT A DESIRED PEAK FREQUENCY

BACKGROUND OF THE INVENTION

1. Field of the Invention

The present invention relates to delay lines, and more particularly, to a delay line that is usable for delaying signal transfer in a computer or a measuring instrument.

2. Description of the Related Art

FIG. 8 and FIG. 9 are respectively a top view of a conventional stripline-type delay line 50 and a cross-section thereof taken along the direction of arrow IX—IX. In the delay line 50, a transmission line 52 used for carrying a signal is folded into a meandering shape and is embedded in a dielectric 51. Ground conductors 53 and 54 (see FIG. 9) are formed on both main surfaces of the dielectric 51 such that they are separated by the transmission line 52 and by dielectric layers 51*a* and 51*b* (see FIG. 9) constituting the dielectric 51.

The ground conductors 53 and 54 are connected to ground terminals 55 and 56 (see FIG. 8), respectively, the ends of the transmission line 52 are connected to an input terminal 57 and an output terminal 58 (see FIG. 8), respectively, and an external resin 59 covers the surrounding area. In the figures, D (see FIG. 9) indicates the distance between the ground conductors, and G (see FIG. 8) indicates the distance between opposing line sections of the transmission line.

The delay time td of the delay line 50 is generally expressed by the following expression, where 1 indicates the total length of the transmission line 52, Co indicates the speed of light, and ∈r indicates the relative dielectric constant of the dielectric layers 51*a* and 51*b*:

$$td = \frac{l\sqrt{\epsilon r}}{Co}$$

In other words, by adjusting the total length l of the transmission line 52, the delay time td can be set to any value.

The conventional delay line described above has the problem that its delay-time varies greatly as a function of frequency. FIG. 10 shows the frequency characteristics of a conventional delay line in which the delay time is designed to be 1.0 ns. A frequency range wherein the delay time is 1.0 ns±50 ps (design value±5%) ranges only from 180 MHz to 330 MHz. Recently, however, the need has arisen for electronic units to be usable at higher frequencies, and delay lines are needed to be used in various frequency ranges. However, this conventional delay line is difficult to use over a wide frequency range.

To solve this problem, namely, to keep the delay time within the design value±5%, G/D has been set to 0.6 or more, since G/D has been found to have a relationship with the variation in the delay time, as shown in FIG. 11. To set G/D to 0.6 or more, however, one of the following measures must be taken:

1. The distance G between opposing line sections of the transmission line must be enlarged; or
2. The distance D between the ground conductors must be reduced If measure (1) is selected, the width of the delay line is enlarged to increase the area, so it is difficult to obtain a compact delay line.

If measure (2) is selected, the dielectric layers provided between the transmission line and the ground conductors are made thinner, so it is difficult to control the thickness of the dielectric layer. In addition, the line width is made narrower in order to achieve impedance matching, so it is difficult to manufacture the delay line.

SUMMARY OF THE INVENTION

The present invention is able to solve these problems. Accordingly, the present invention can provide a compact delay line in which the delay time is stable and has little variation within the frequency ranges of its use, and the thickness of the dielectric layers can be easily controlled.

The foregoing feature may be achieved according to the present invention through the provision of a delay line including: a dielectric, which may comprise a plurality of laminated dielectric layers; a meander-shaped transmission line embedded in the dielectric having opposing line sections; and at least two ground conductors which oppose each other on opposite sides of the transmission line and the dielectric, wherein the length A of the opposing line sections of the transmission line is set such that the first peak frequency f of the delay time is within or above the frequency range of use, and substantially satisfies the following expression:

$$f = \frac{Co}{4A\sqrt{\epsilon r}}$$

wherein Co indicates the speed of light, and ∈r indicates the relative dielectric constant of the dielectric layers.

In such a delay line, by controlling the length A of the opposing line sections of the transmission line by use of the foregoing expression to set the first peak frequency f of the delay time within or above the frequency range of use, a stable delay time having little variation can be obtained in a design phase in the frequency range of use.

Conversely, a frequency range in which the delay time is stable and has little variation, namely, a frequency range in which the delay line can be used, can be obtained in the design phase.

Therefore, the time required for manufacturing the delay line can be reduced and the manufacturing cost thereof can also be reduced.

The delay line may further be configured such that $0<G/D<0.6$ is substantially satisfied, wherein D indicates the distance between the ground conductors and G indicates the distance between opposing line sections of the transmission line.

In such a delay line, if $0<G/D<0.6$ is satisfied, since a stable delay time having little variation can be obtained in the frequency range of use, the distance G between opposing line sections of the transmission line can be reduced while D remains the same, as compared with a conventional delay line having $G/D \geqq 0.6$, and the area occupied by the delay line can be made smaller.

Since the distance D between the ground conductors can be made larger with G remaining the same, as compared with a conventional delay line having $G/D \geqq 0.6$, the thickness of the dielectric layers constituting the dielectric can be easily controlled. The manufacturing process for the delay line can be simplified and the time required for manufacturing the delay line can also be reduced. In addition, since the line width can he made larger, insertion loss can be reduced.

The delay line may further be configured with the transmission line formed by a plurality of transmission line sections, wherein the transmission line sections adjacent to each other in the lamination direction may be electrically connected.

In such a delay line, by connecting a plurality of transmission line sections in series with conductors formed through the dielectric, the plurality of transmission line sections can be laminated in the height direction of the dielectric. Therefore, the area occupied by the delay line can be further reduced.

In a delay line according to the present invention, the length A of opposing line portions of the transmission line can be controlled in a design phase such that the first peak frequency of the delay line is within or greater than the intended frequency range of its uses.

DESCRIPTION OF EMBODIMENTS OF THE INVENTION

Figure 1:
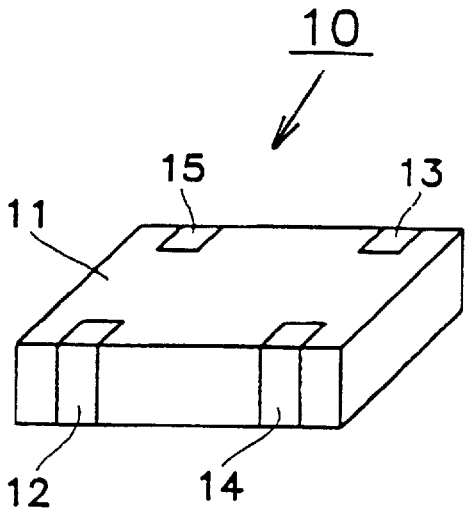
FIG. 1 is a perspective view of a delay line according to a first embodiment of the present invention.

Embodiments of the present invention will be described below by referring to the drawings, in which like reference numerals and letters indicate corresponding elements and parts.

Figure 2:
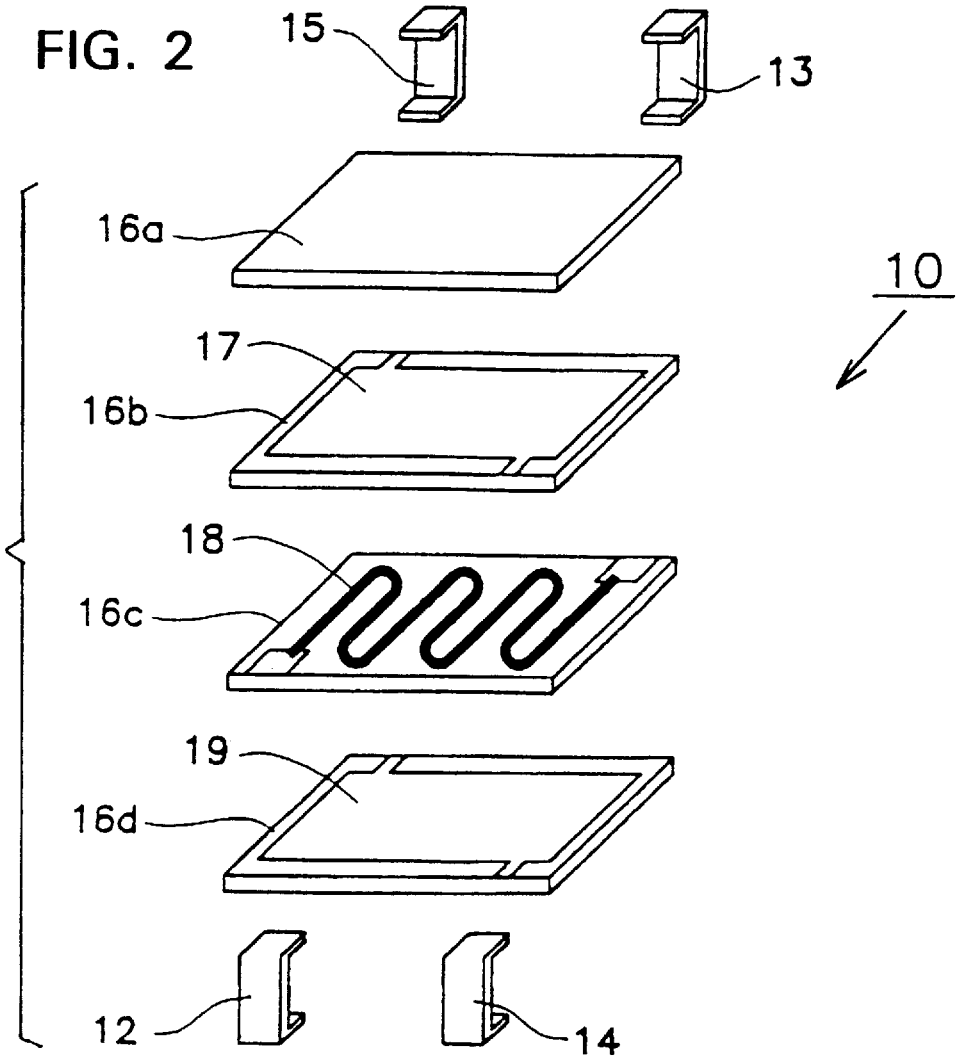
FIG. 2 is an exploded perspective view of the delay line shown in FIG. 1.

FIG. 1 and FIG. 2 are respectively a perspective view and an exploded perspective view of a delay line according to a first embodiment of the present invention.

A delay line 10 is of a stripline type and includes a rectangular parallelepiped dielectric 11 (see FIG. 1), an input terminal 12, an output terminal 13, and two ground terminals 14 and 15, all of these terminals being formed at side faces and the upper and lower surfaces of the dielectric 11.

As seen in FIG. 2, rectangular dielectric sheet layers 16*a* to 16*d* with a relative dielectric constant ∈r of about 6.3 have barium oxide, aluminum oxide, and silica as main components. The sheet layer 16*a* is placed at the top, and the other layers are laminated thereunder in the following order: the sheet layer 16*b* on which a ground conductor 17 is formed on its upper surface, the sheet layer 16*c* on which a transmission line 18 folded into a meander shape is formed on its upper surface, and the sheet layer 16*d* on which a ground conductor 19 is formed on its upper surface.

The sheet layers 16*a* to 16*d* are laminated and then baked to form the dielectric 11. As best seen in FIG. 1, the input terminal 12, the output terminal 13, and the ground terminals 14 and 15 are formed by printing electrode material on side faces of the laminated dielectric 11 near its corners, and on portions of the upper and lower surfaces connected thereto. The terminals 12–15 are baked at the same time as the dielectric 11 to form the delay line 10. The sheet layers 16*a* to 16*d* are integrated when they are baked.

Alternatively, the terminals 12 to 15 may be formed after the dielectric 11 is baked.

Both ends of the transmission line 18 and parts of the ground conductors 17 and 19 are led to side faces of the dielectric 11 and connected to the input terminal 12, the output terminal 13, and the ground terminals 14 and 15. The input and output terminals 12 and 13 are formed near ends of one diagonal of the dielectric 11, while the ground terminals 14 and 15 are formed near the ends of the other diagonal.

Figure 3:
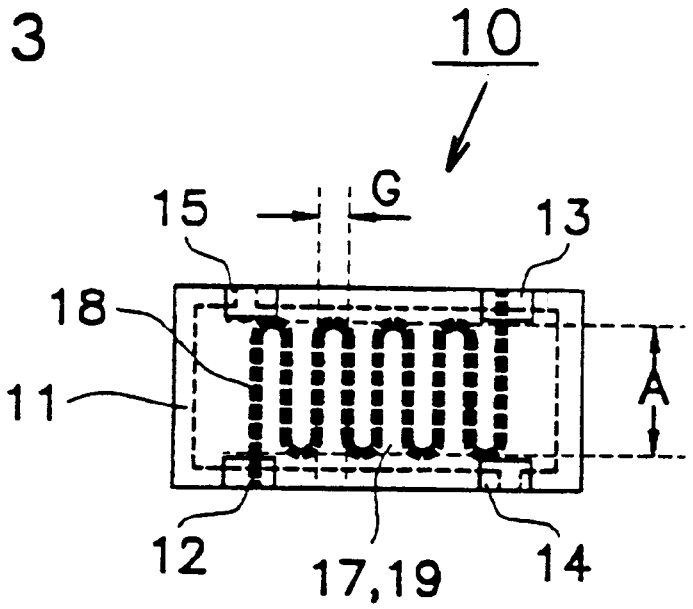
FIG. 3 is a top view of the delay line shown in FIG. 1.
Figure 4:
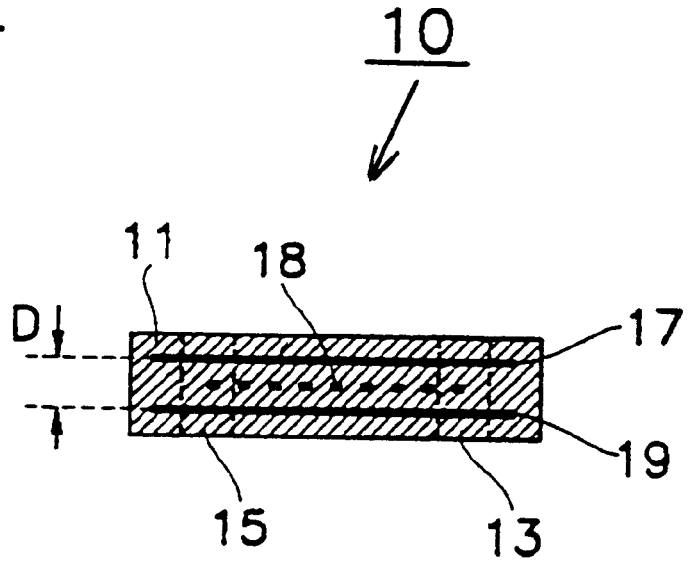
FIG. 4 is a cross-section of the delay line shown in FIG. 1.

FIG. 3 and FIG. 4 are a top view and a cross-section of the delay line 10 shown in FIG. 1. In FIG. 3, A indicates the length of the opposing line sections of the transmission line 18, and G indicates the distance between opposing line sections of the transmission line 18. In FIG. 4, D indicates the distance between the ground conductors 17 and 19.

Table 1 shows the relationship between the length A of the opposing line sections of the transmission line 18 and the first peak frequency f of the delay time, with measured values. In the measurement, a delay time was measured between the input terminal 12 and the output terminal 13, connected respectively to the ends of the transmission line 18, while the first peak frequency was measured for each given length A of the opposing line sections.

| A (mm) | f (GHz) |
|---|---|
| 2.32 | 12.601 |
| 3.30 | 9.400 |
| 4.32 | 7.024 |
| 6.30 | 4.750 |
| 8.32 | 3.774 |

From these results, the relationship between the length A of the opposing line sections of the transmission line 18 and the first peak frequency f of the delay time is obtained by the least-squares method as follows:

$$f = \frac{Co}{4A\sqrt{\epsilon r}} \tag{1}$$

Wherein Co indicates the speed of light and ∈r indicates the relative dielectric constant of a dielectric layer.

Figure 5:
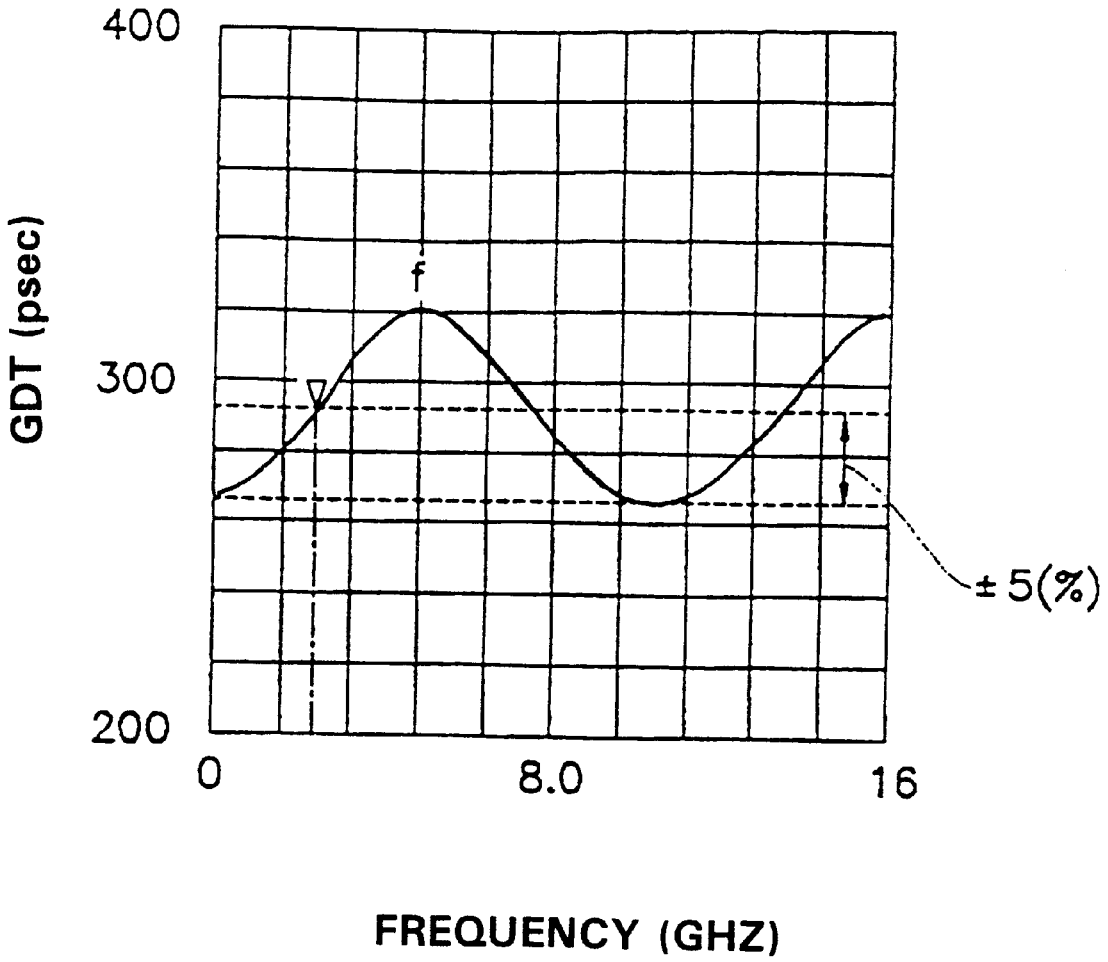
FIG. 5 is a chart indicating the relationship between frequency and delay time when the length of the opposing line sections of the transmission line is 6 mm.

FIG. 5 indicates the frequency response of the delay time of the delay line shown in FIG. 1. In this case, G/D is set to 0.4, the relative dielectric constant ∈r of a dielectric layer is set to 6, and the width W of the transmission line is set to 150 μm. The length A of the opposing line sections is set to 6 mm, based on the above expression (1), such that the first peak frequency f is about 5 GHz, which is above the frequency range (0 to 3 GHz) of its use, As clearly understood from the figure, the delay time is within 280 ps±14 ps (design value±5%) at the frequency range of its use, 0 to 3 GHz.

Figure 6:
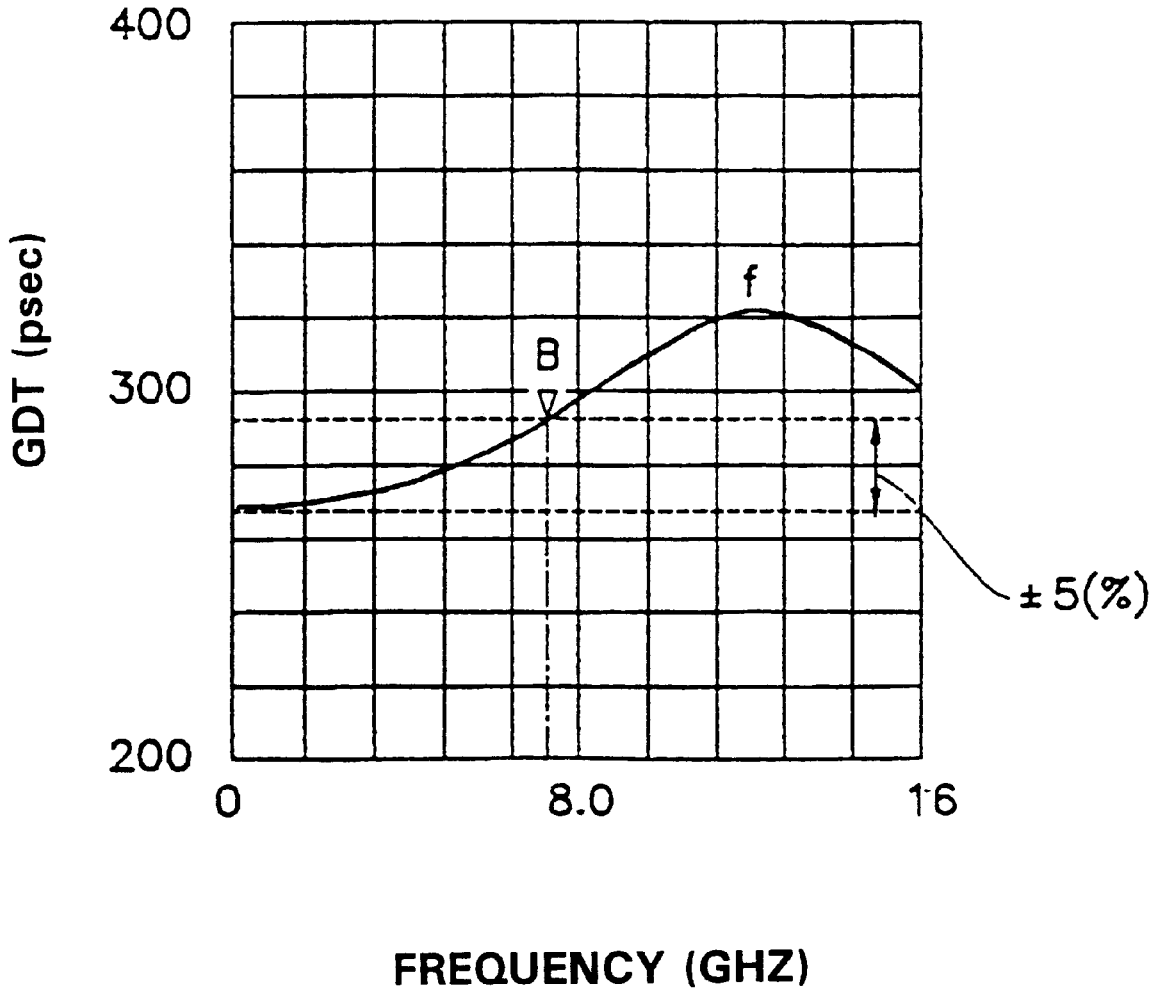
FIG. 6 is a chart indicating the relationship between frequency and delay time when the length of the opposing line sections of the transmission line is 2 mm.

FIG. 6 indicates the frequency response of the delay time with the frequency range of use being extended to higher frequencies. In this case, G/D is set to 0.4, the relative dielectric constant ∈r of a dielectric layer is set to 6, and the width W of the transmission line is set to 150 μm. The length A of the opposing line sections is set to 2 mm, based on the above expression (1), such that the first peak frequency f is about 12 GHz, which is above the frequency range (0 to 7 GHz) of its use, the 0 to 7 GHz frequency range being indicated to the left of point B in FIG. 6. As clearly understood from the figure, the delay time is within 280 ps±14 ps (design value±5%) at the frequency range of its use, 0 to 7 GHz.

As described above, according to the delay line of the first embodiment, by controlling the length A of the opposing line sections of the transmission line by use of expression (1) to set the first peak frequency f of the delay time at or above the frequency range of use, the delay time can be set in a design phase to the design value±5% at the frequency range of use.

Conversely; a frequency range in which the delay time is within the design value±5%, namely, a frequency range in which the delay line can be used, can be obtained in the design phase.

Also, if 0<G/D<0.6 is satisfied, since the delay time can he set to the design value±5% in the frequency range of use, the distance G between opposing line sections of the transmission line can be reduced with D remaining the same, as compared with a conventional delay line having G/D≧0.6, and the delay line can be made more compact.

Since the distance D between the ground conductors can he made larger with G remaining the same, as compared with a conventional delay line having G/D≧0.6, the thickness of the dielectric layers constituting the dielectric can be easily controlled. In addition, since the line width can be made larger, insertion loss can be reduced.

Figure 7:
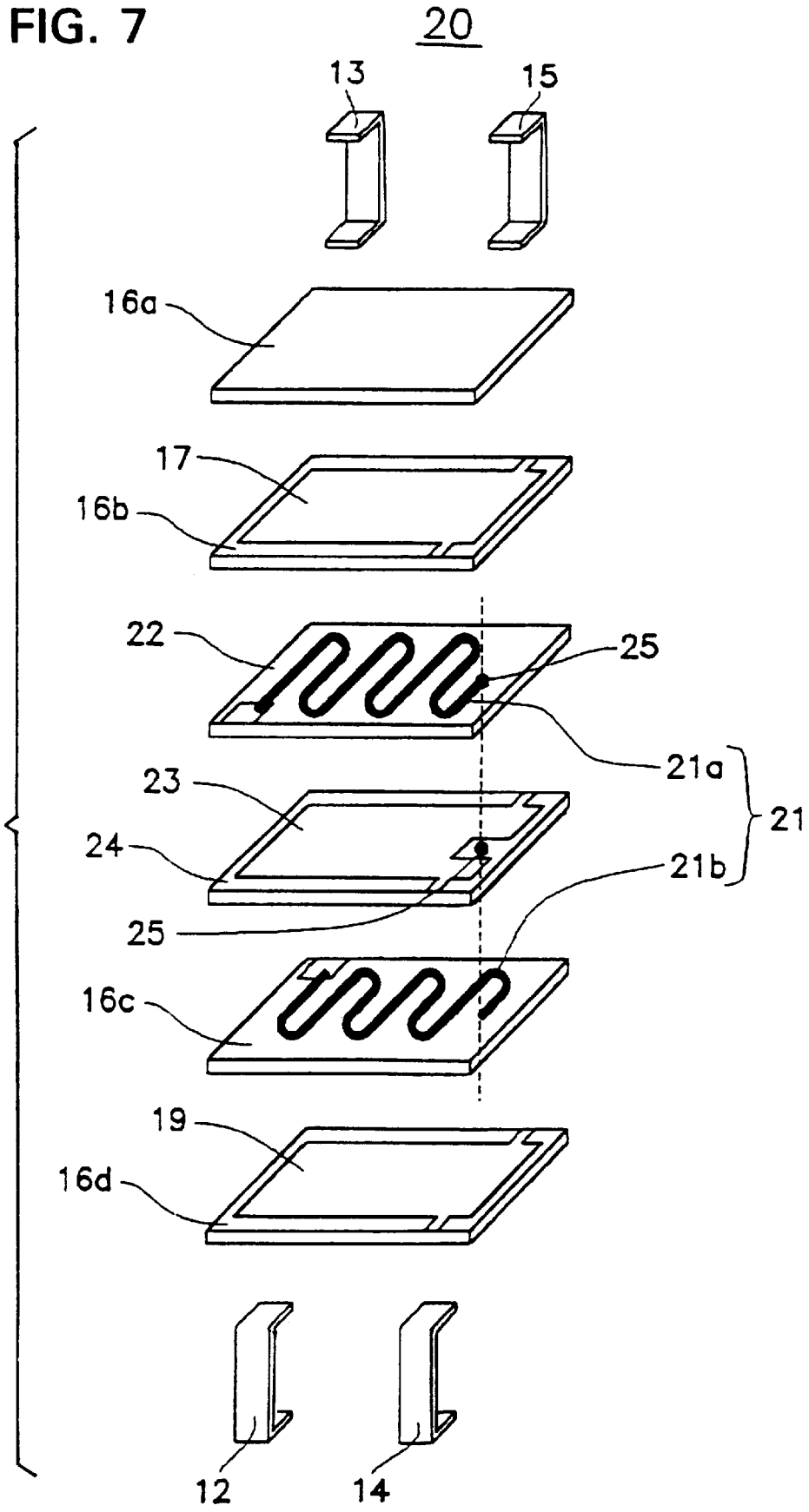
FIG. 7 is an exploded perspective view of a delay line according to a second embodiment of the present invention.
Figure 8:
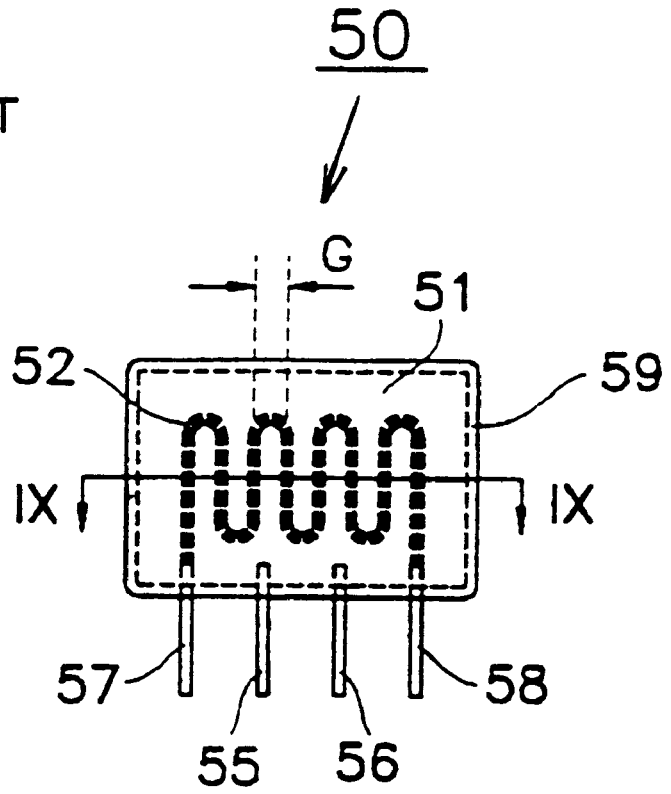
FIG. 8 PRIOR ART
FIG. 8 is a top view of a conventional microstrip-type delay line.
Figure 9:
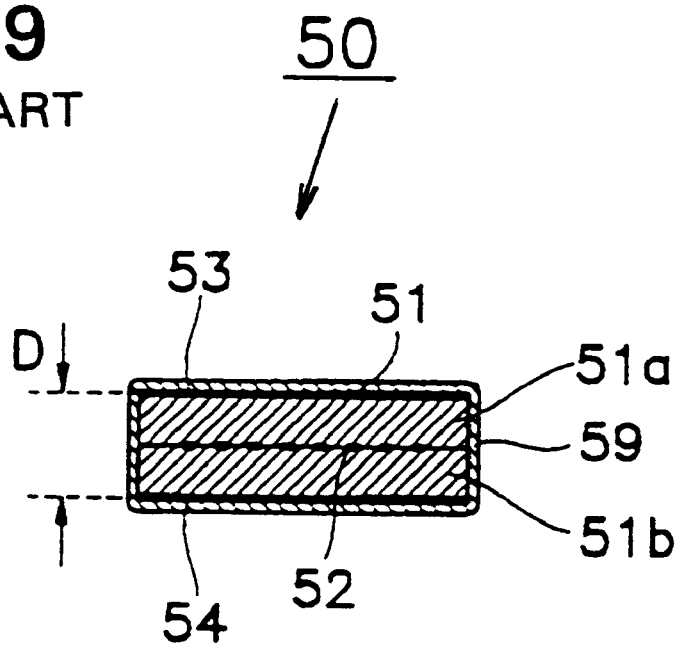
FIG. 9 PRIOR ART
FIG. 9 is a cross-section of the delay line shown in FIG. 8.
Figure 10:
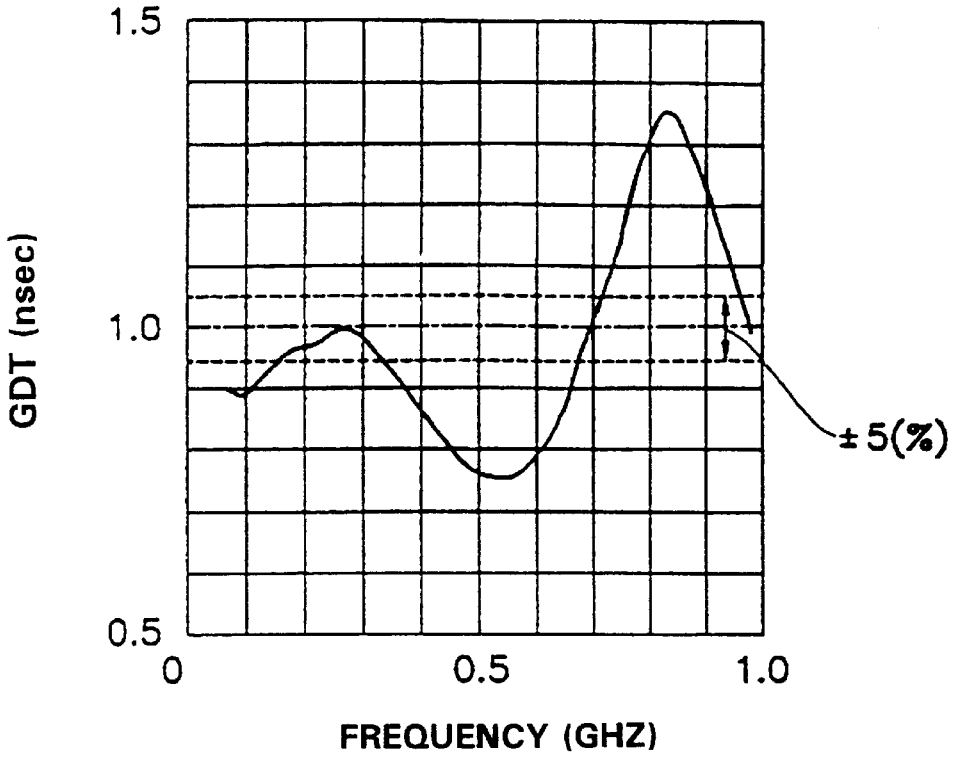
FIG. 10 PRIOR ART
FIG. 10 is a chart indicating the relationship between frequency and delay time of the delay line shown in FIG. 8.
Figure 11:
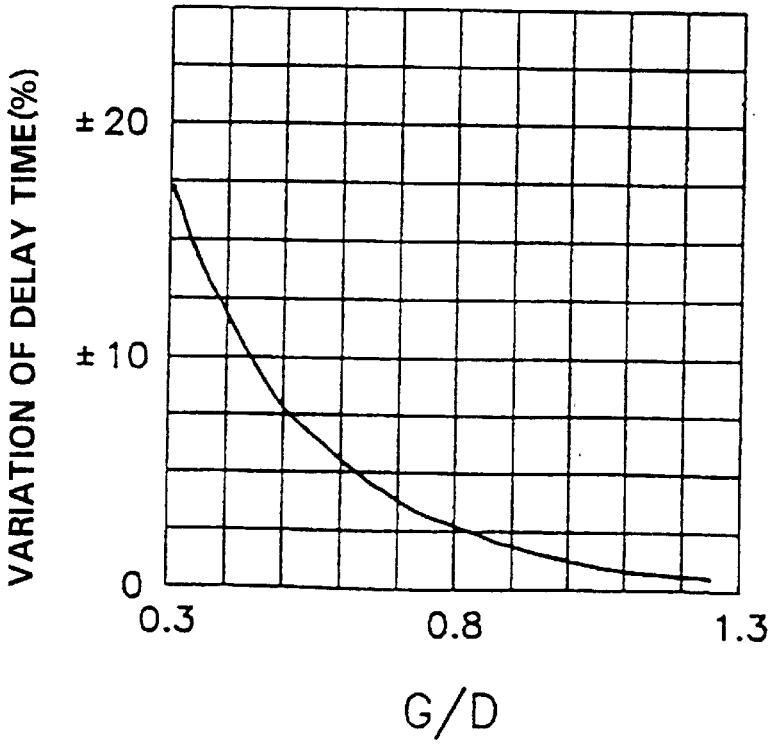
FIG. 11 PRIOR ART
FIG. 11 is a chart indicating the relationship between G/D and variation of the delay time.

FIG. 7 is an exploded perspective view of a delay line 20 according to a second embodiment of the present invention. The delay line 20 differs from the delay line 10 according to the first embodiment in that two transmission lines 21*a* and 21*b*, which together constitute a transmission line 21 formed inside the dielectric 11, are disposed such that they oppose each other through a dielectric layer 22, a ground conductor 23, and a dielectric layer 24. The two transmission lines 21*a* and 21*b* are connected with a conductor such as a via hole 25 to form the transmission line 21. As for the other components in the second embodiment, the same numbers as in the first embodiment are assigned to the same or similar portions as those in the first embodiment, and a detailed description thereof will be omitted.

As described above, in the delay line according to the second embodiment, since the two transmission lines 21*a* and 21*b* are connected in series by the via hole 25 which passes through the dielectric layer 22, the ground conductor 23, and the dielectric layer 24, in addition to the advantages obtained in the first embodiment, the area of the delay line can be reduced.

In the first and second embodiments, the dielectric layers are made from ceramic having barium oxide, aluminum oxide, and silica as main components. Other materials having a relative dielectric constant (∈r) of 1 or more may be used, such as fluorocarbon resin and a ceramic having magnesium oxide and silica as main components.

The ground conductors are embedded in the dielectric in the above embodiments. At least two ground conductors disposed oppositely on both sides of a transmission line and a dielectric layer are required and all or part of the ground conductors may be formed on a surface of the dielectric.

In the above embodiments, the dielectric has a rectangular parallelepiped shape. The dielectric may also have other shapes, such as a cubic, cylindrical, pyramid, conic, or spherical shape.

In the first embodiment, G/D is set to 0.4. G/D may be any value as long as it satisfies 0<G/D<0.6. If G/D is equal to 0, it means that either G equals 0 or D is infinite, and in either case the corresponding structure does rot actually exist. If G/D is 0.6 or more, G/D is too large and the delay line becomes too large.

In the second embodiment, the two transmission lines are laminated and connected in series. Transmission lines may also be laminated in three layers or more. In this case, as the number of transmission lines increases, the area of the delay line is made smaller.

When three or more transmission lines are laminated, they may be configured such that a plurality of transmission lines is formed in different layers and laminated. Alternatively, a plurality of layers in which one or more transmission lines are formed in one layer may be laminated.

The via hole is used for connecting the two transmission lines. A through hole or an electrode formed at a side face of the dielectric may also be used.

In the second embodiment and in the above-described modified embodiments, a plurality of transmission lines are separated by the dielectric layers and the ground conductor. However, they may be separated only by the dielectric layers. In this case, by forming the plurality of transmission lines perpendicular to each other, it is mace less likely that electromagnetic coupling will be generated between the transmission lines, so the ground conductor is not required.

What is claimed is:

1. A delay line with an intended frequency range of use, comprising:

a dielectric;

a transmission line having a meandering shape which defines a meandering length A, said transmission line being embedded in said dielectric and having opposing line sections; and at least two ground conductors disposed on said dielectric such that said ground conductors oppose each other with said transmission line located therebetween, and said ground conductors are separated from said transmission line by said dielectric, wherein the meandering length A of the opposing line sections of said transmission line is set such that the delay time has a first peak frequency f which is not lower than the intended frequency range of use, and substantially satisfies the following expression:

$$f = \frac{Co}{4A\sqrt{\epsilon r}}$$

wherein Co indicates the speed of light, and ∈r indicates the relative dielectric constant of said dielectric.

2. A delay line according to claim 1, which substantially satisfies a condition 0<G/D<0.6 wherein D indicates the distance between said ground conductors and G indicates the distance between opposing line sections of said transmission line.

3. A delay line according to claim 2, wherein said transmission line is comprised of a plurality of transmission line segments separated by said dielectric, and said transmission line segments adjacent to each other are electrically connected.

4. A delay line according to claim 3, wherein said dielectric comprises a plurality of laminated dielectric layers and each adjacent pair of said plurality of transmission line segments are separated by a respective one of said layers.

5. A delay line according to claim 4, wherein each said adjacent pair of transmission line segments are electrically connected through said respective one of said layers.

6. A delay line according to claim 1, wherein said transmission line is comprised of a plurality of transmission line segments separated by said dielectric, and said transmission line segments adjacent to each other are electrically connected.

7. A delay line according to claim 6, wherein said dielectric comprises a plurality of laminated dielectric layers and each adjacent pair of said plurality of transmission line segments are separated by a respective one of said layers.

8. A delay line according to claim 7, wherein each said adjacent pair of transmission line segments are electrically connected through said respective one of said layers.

9. A delay line according to claim 1, wherein said dielectric comprises a plurality of laminated dielectric layers.

10. A delay line according to claim 1, wherein said first peak frequency f of the delay time is above the intended frequency range of use.

* * * * *